US005123875A

United States Patent [19]

Eubank et al.

[11] Patent Number: 5,123,875

[45] Date of Patent: Jun. 23, 1992

[54] POWER ACTUATED ROOF VENT APPARATUS AND METHOD OF USE

[75] Inventors: Mark A. Eubank; Michael P. Eubank, both of Longview, Tex.

[73] Assignee: Eubank Manufacturing Enterprises, Inc., Longview, Tex.

[21] Appl. No.: 684,335

[22] Filed: Apr. 12, 1991

[51] Int. Cl.[5] ..... F24F 11/00

[52] U.S. Cl. ..... 454/342; 454/343; 454/347; 454/350; 236/44 C

[58] Field of Search ..... 98/42.03, 42.04, 42.12, 98/116; 49/31; 236/49.3, 44 C

[56] References Cited

U.S. PATENT DOCUMENTS

| | | | |
|---|---|---|---|
| 1,971,920 | 8/1934 | Ross | 98/116 X |
| 2,159,498 | 5/1939 | Birkholz | 98/116 |
| 2,612,831 | 10/1952 | Lohman, Jr. | 98/116 X |
| 3,116,679 | 1/1964 | Solem | 98/116 |
| 3,307,469 | 3/1967 | Bohanon | 98/42.04 X |
| 4,036,120 | 7/1977 | Burtenshaw | 98/116 X |
| 4,633,769 | 1/1987 | Milks | 98/116 X |
| 4,911,065 | 3/1990 | Van Becelaere | 98/42.03 X |

FOREIGN PATENT DOCUMENTS

| | | | |
|---|---|---|---|
| 65852 | 5/1980 | Japan | 98/116 |
| 29934 | 2/1984 | Japan | 98/116 |

*Primary Examiner*—Harold Joyce
*Attorney, Agent, or Firm*—Ronald B. Sefrna

[57] ABSTRACT

A power actuated roof vent apparatus generally comprises an insulated air passageway housing through the roof which allows a linear and unrestricted air flow through the air passageway housing when the apparatus is in opération and an insulated passageway closure lid which positively closes the air flow through, and prohibits water ingress into, the air passageway housing when the apparatus is not in operation. The apparatus further comprises a power actuated fan assembly positioned within the air passageway housing to move large volumes of air with low noise levels and low power requirements; a power actuated closure assembly to open and close the passageway closure lid remotely and provided with an emergency backup power source in order to close the passageway closure lid in the event of a line power failure; and a power actuated switching system to coordinate operation of the fan with the opening and closing of the passageway closure lid, and, alternatively, to activate closing of the passageway closure lid upon the occurrence of intruding rain or snow or in the event of a fire.

35 Claims, 2 Drawing Sheets

POWER ACTUATED ROOF VENT APPARATUS AND METHOD OF USE

FIELD OF THE INVENTION

The present invention generally relates to roof ventilation systems, and more specifically relates to a roof vent apparatus particularly useful for quietly removing large volumes of air from an enclosed area through the roof thereof and to a method of coordinating the operational characteristics of the apparatus.

BACKGROUND OF THE INVENTION

It is common practice to provide roof vents in buildings, for heat removal and other ventilating purposes, especially in buildings having large enclosed, high-roofed areas such as warehousing and manufacturing facilities. The roof ventilation systems known in the prior art include passive systems which depend primarily on the natural upward flow of warm air relative to cooler air, and systems which utilize power actuated fans or turbines to force air from the area immediately below the roof of the building through some form of passageway penetrating the roof.

Various approaches to vent an enclosed area through the roof have been attempted and are known in the prior art, but none of the approaches have successfully addressed providing a simple, quiet, and economically efficient apparatus and method of use to accomplish the task of quietly removing large volumes of air from an enclosed area through the roof thereof. Some approaches to power actuated ventilation systems which are known within the prior art typically use air passageway designs in which the air flow is not linear through the passageway, but is curved in some manner in an effort to prevent the entry of rain into the interior of the building through the passageway. Other approaches to power actuated ventilation systems utilize a linear passageway with a flapper valve or other closure means which depends upon the flow of air to hold the closure means in an open position during operation of a fan used to move the air through the system. In the approaches to those systems of the prior art, the air flow through the passageway is restricted, either by turbulence alone or in combination with the force of the closure means. As a result of the restriction and resulting turbulence, it has been necessary to employ fan motors of relatively high power, and correspondingly high noise levels and increasingly higher cost and power usage. Further, the air turbulence associated with such systems creates relatively high noise levels in addition to the fan motor noise. In addition, the ventilation systems of the prior art are typically uninsulated and do not attempt to inhibit heat loss through such systems. Also, the ventilation systems of the prior art typically do not effectively seal the air passageway against passive flow of air when it is not desired to remove air from the interior of the building and the fan is inactive.

U.S. Pat. No. 2,299,317 to Fink discloses a closure for roof hatches wherein a strictly manual means is employed to mechanically lift and swing open the hatch closure by using a rotatable worm gear and mating worm wheel with a plurality of interfacing rods and levers pivotally interconnected between the worm wheel and the hatch closure. This approach only addresses the movement of the hatch closure and the associated mechanism to accomplish that movement. Thus, this approach does not address the capability of the apparatus to be used in conjunction with other devices such as electric fans to effectuate active air flow movement rather than passive air flow movement. This approach also appears to lack any reference to automatic closure of the hatch upon the occurrence of an undesirable event, such as rain or snow or fire, since a purely manual system is anticipated. Also, this approach fails to address any insulating means to prevent or reduce heat loss through the apparatus while closed.

U.S. Pat. No. 2,711,682 to Drechsel discloses a power roof ventilator by essentially providing a rigid vent structure with downwardly sloping discharging baffles and movable louvers located below the centrifugal fan and fan motor. The movable louvers are designed to control the volume of air flow through the apparatus and are opened and closed by a separate motor. The movable louvers are considered closed when the louvers are horizontal and overlap each other. The air flow exiting the apparatus through the discharging baffles is primarily in the opposite direction of the air flow entering the apparatus through the louvers, consequently causing a turbulent air flow pattern which creates additional noise and requires a greater usage of electrical power to operate a more powerful fan motor. This approach, however, does not address a means for forming a positive seal in the closed position of the louvers so as to eliminate a passive air flow through the apparatus. Furthermore, this approach does not address a means for inhibiting heat loss through the apparatus while not being used.

There remains an unfilled need for a simple, quiet, and economically efficient power actuated roof vent apparatus capable of providing an effective means of removing large volumes of air from an enclosed area through the roof thereof, while addressing and overcoming the disadvantages associated with ventilation systems known in the prior art.

SUMMARY OF THE INVENTION

The power actuated roof vent apparatus of the invention generally comprises a short, air passageway housing through the roof of an enclosed area which allows a linear and unrestricted air flow through the air passageway housing when the apparatus is in operation and an air passageway closure lid which positively closes the air flow through, and prohibits water ingress into, the air passageway housing when the apparatus is not in operation. The air passageway housing and passageway closure lid typically include an insulating means, internally or externally or both, to prevent or reduce unnecessary heat loss through the apparatus when the apparatus is not in operation. The apparatus of the invention further comprises a power actuated fan assembly positioned within the air passageway housing having a low power, low speed fan motor with a low speed, high volume fan interconnected thereto in order to move large volumes of air with low noise levels. Furthermore, the apparatus of the invention comprises a power actuated closure assembly interconnected between the air passageway housing and the closure lid having a low voltage actuator drive motor and an actuator shaft in order to open and close the closure lid remotely, and provided with an emergency backup power source in order to close the closure lid in the event of a line power failure. A step-down transformer is provided to convert the main power supply to the electrical requirements to operate the low voltage actuator motor and which is compatible with the emergency backup power source. The apparatus of the invention further comprises a power actuated switching system to coordinate operation of the fan with the opening and closing of the passageway closure lid having a master actuator switch, a fan motor limit switch, an upper and a lower closure limit switch, and a relay. The master actuator switch controls the operation of the actuator drive motor to either open or close the passageway closure lid. The fan motor limit switch delays the operation of the fan motor until the air passageway closure lid is sufficiently opened to permit quiet air flow, and then deactivates the fan motor when the air passageway closure lid is closed to a predetermined point. The upper and lower closure limit switches deactivate the closure actuator motor when the air passageway closure lid is fully opened or closed, respectively. The relay coordinates the voltage polarity as applied to the actuator motor so that the actuator motor operates in the desired direction either as demanded by the user or upon a main power failure. Alternatively, a humidstat or other moisture sensing device, or a heat sensor and/or smoke detector, may be incorporated within the switching system to close the air passageway closure lid upon the occurrence of intruding rain or snow or in the event of a fire.

The structure and use of the preferred embodiment of the power actuated roof vent apparatus of the invention will now be described in more detail, with reference to the accompanying drawing figures.

DETAILED DESCRIPTION OF THE INVENTION

Figure 1:
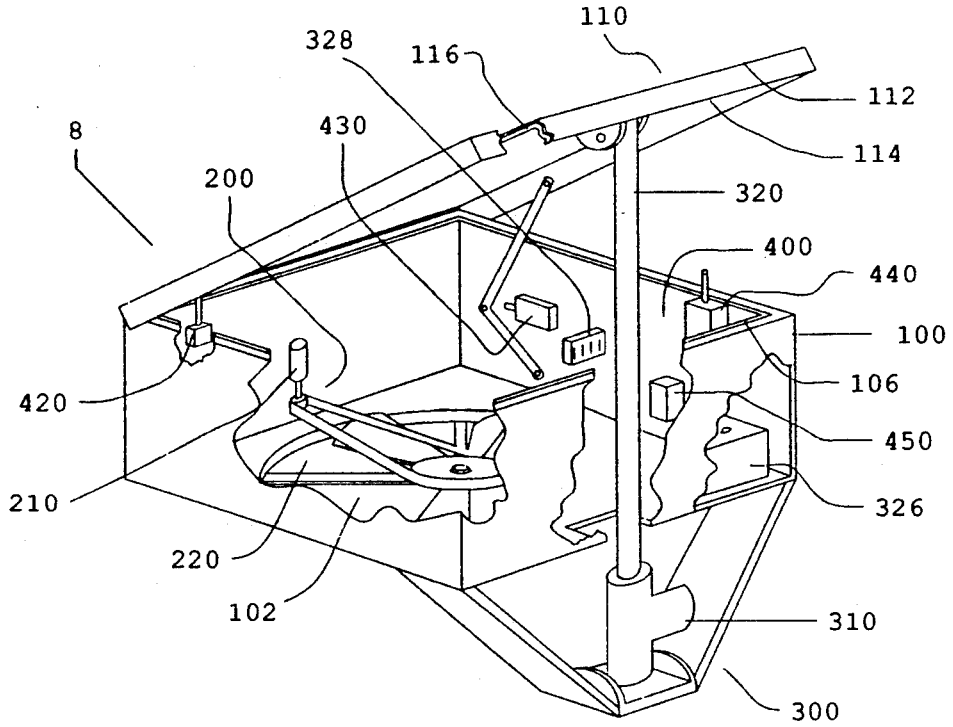
FIG. 1 is a partial cut-away perspective view of the preferred embodiment of the power actuated roof vent apparatus of the invention in a partially open position.
Figure 4:
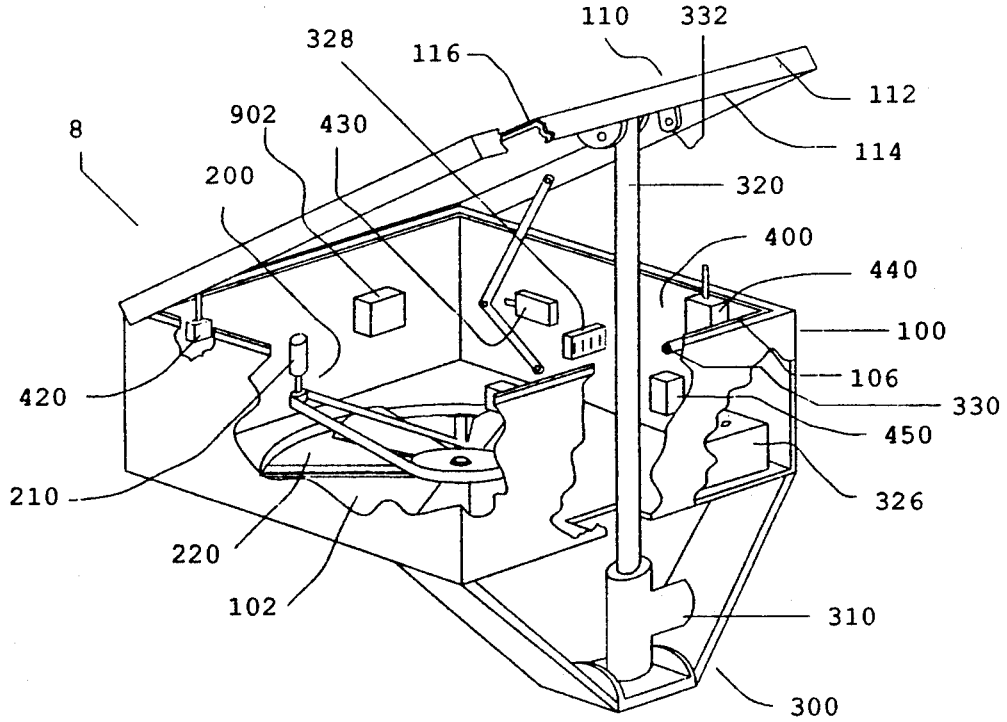
FIG. 4 is a partial cut-away perspective view of an alternative embodiment of the power actuated roof vent apparatus of the invention in a partially open position incorporating a humidistat or other moisture sensing device and a heat sensor and/or smoke detector.
Figure 2:
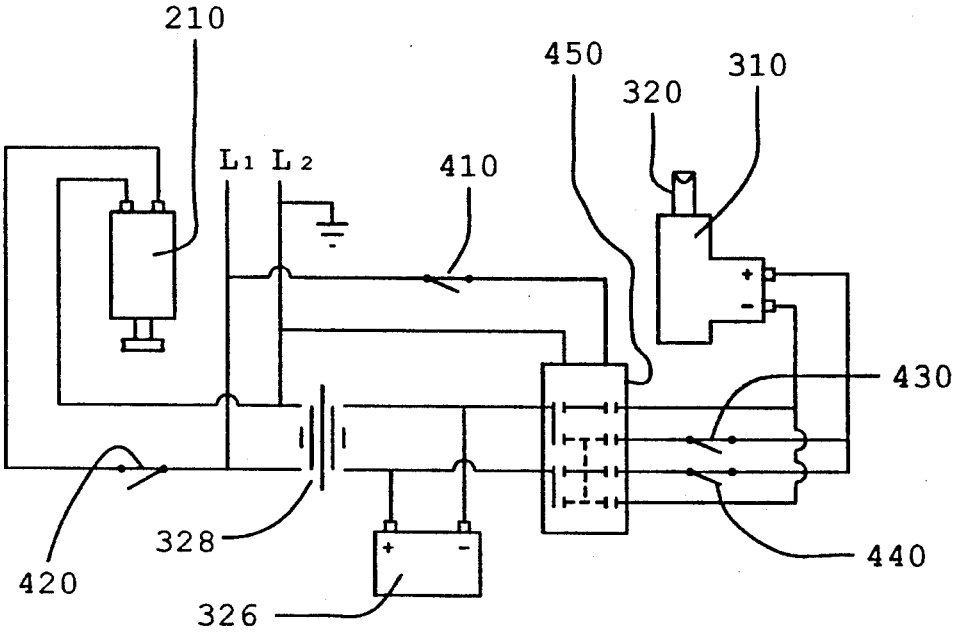
FIG. 2 is an electrical schematic of the preferred embodiment of the power actuated roof vent apparatus of the invention utilizing a single phase power source.
Figure 3:
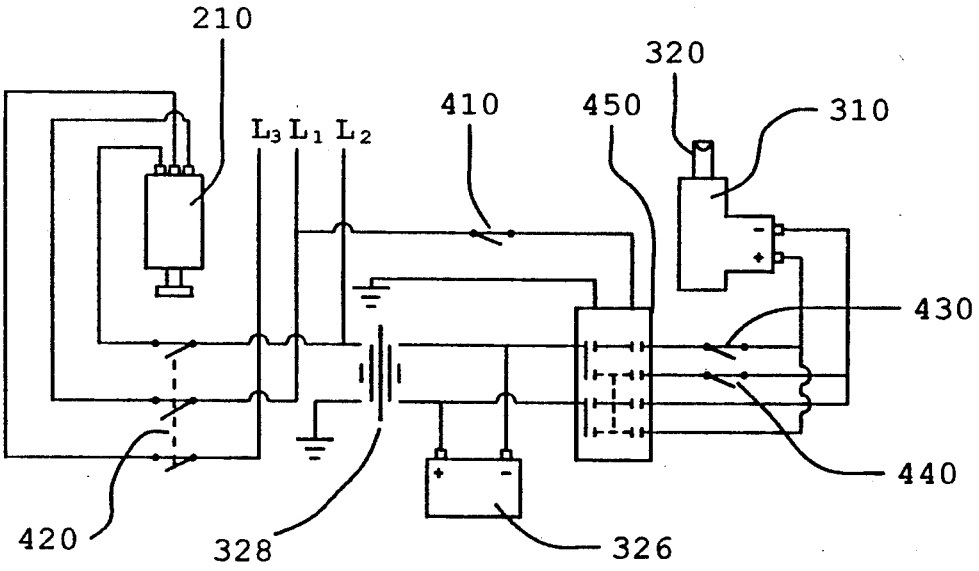
FIG. 3 is an electrical schematic of an alternative embodiment of the power actuated roof vent apparatus of the invention utilizing a three phase power source.

With reference to the four (4) accompanying figures, the power actuated roof vent apparatus of the invention, generally designated by reference numeral 8, is shown to comprise a short, air passageway housing 100 through the roof of an enclosed area, such as a building or other such structure, creating air passageway 102 which allows a linear and unrestricted air flow through air passageway housing 100 when apparatus 8 is in operation and an air passageway closure lid 110 which positively closes the air flow through, and prohibits water ingress into, air passageway housing 100 when apparatus 8 is not in operation. Apparatus 8 of the invention further comprises a power actuated fan assembly 200 positioned within air passageway housing 100 to move large volumes of air with low noise levels. Furthermore, apparatus 8 of the invention comprises a power actuated closure assembly 300 interconnected between air passageway housing 100 and closure lid 110 to open and close closure lid 110 remotely. Apparatus 8 of the invention further comprises a power actuated switching system 400 to coordinate operation of fan assembly 200 with the opening and closing of closure lid 110.

Air passageway housing 100 preferably comprises a box-like hollow rectangular structure (although any suitable configuration may be utilized, i.e. circular) to be interconnected to the exterior surface of the roof surrounding a relatively large aperture penetrating the roof of a building or other enclosed structure. The interconnection of air passageway housing 100 to the roof is made by conventional means so as to provide a watertight seal at the intersection of air passageway housing 100 and the roof, and is made with sufficient bracing for proper stability. Although it is preferred that air passageway housing 100 be interconnected to the roof of the enclosed structure, the housing may be interconnected around an aperture extending through a side wall of the structure if desired. Air passageway housing 100 preferably includes an insulating means 106 positioned internally (although such insulating means may also be positioned externally) so as to prevent or reduce unnecessary heat loss through apparatus 8 when apparatus 8 is not in operation.

Air passageway closure lid 110 comprises a substantially planar closure cover 112 of the same general configuration and slightly larger than the exterior dimensions of air passageway housing 100, with a downwardly projecting perimeter lip 114 to extend a short distance over the side walls of air passageway housing 100 and form a positive seal between closure lid 110 and air passageway housing 100. Closure lid 110 is pivotally interconnected to air passageway housing 100 so that it can be lifted therefrom to open air passageway housing 100. Closure lid 110 preferably includes an insulating means 116 positioned internally (although such insulating means may also be positioned externally) so as to prevent or reduce unnecessary heat loss through apparatus 8 when apparatus 8 is not in operation.

Fan assembly 200 comprises a high voltage (e.g., 125 VAC, 240 VAC, or higher), low power electric fan motor 210 adapted to provide a low rotational speed output drive, and a large diameter impeller-type fan 220 designed to move large volumes of air at a low rotational speed. In the preferred embodiment, fan 220 is interconnected to fan motor 210 and driven by a conventional drive belt and pulley system, but a direct drive system could be utilized if desired. It is preferred that fan 220 include a central hub with a plurality of blades symmetrically disposed around and interconnected to the hub, with an axle extending through the hub and interconnected thereto. Fan 220 is supported within air passageway 102 by a support means, preferably including a bearing assembly connected to the fan axle for rotation of the axle therein, and a plurality of struts interconnected between the bearing assembly and air passageway housing 100 to support the bearing assembly, and thus fan 220, in a fixed position within the housing.

Closure actuator assembly 300 comprises a low voltage (preferably 36 VDC) reversible electric actuator drive motor 310 with low speed gear drive output disposed below the roof level within the building or other structure and pivotally interconnected to air passageway housing 100 by appropriate rigid supports and bracing for stability during operation. Also, closure actuator assembly 300 comprises an actuator shaft 320 pivotally interconnected to closure lid 110 and adapted and disposed to be driven by actuator drive motor 310. The pivotal axes for the aforementioned pivotal interconnections are parallel to the longitudinal axis of the pivotal interconnection between closure lid 110 and air passageway housing 100. In the preferred embodiment, a low voltage (preferably 36 VDC) backup battery 326 is provided to activate closure actuator assembly 300 in order to close air passageway housing 100 in the event of a main power source failure. A step-down transformer 328 is also provided to convert standard high voltage AC power to the preferred 36 VDC for normal operation of closure actuator assembly 300 and to maintain backup battery 326 in a fully charged condition.

Switching system 400 comprises a remotely positioned master actuator switch 410, a normally closed fan motor limit switch 420, a normally closed upper closure limit switch 430, a normally closed lower closure limit switch 440, and a relay 450. Master actuator switch 410 activates and deactivates the apparatus as a whole and specifically controls the operation of actuator drive motor 310 to either extend or retract closure actuator assembly 300, thereby either opening or closing closure lid 110. Fan motor limit switch 420 delays the operation of fan motor 210 until closure lid 110 is sufficiently opened to permit quiet air flow and then deactivates fan motor 210 when closure lid 110 is closed to a predetermined point. Upper closure limit switch 430 deactivates actuator drive motor 310 when closure lid 110 is fully opened and lower closure limit switch 440 deactivates actuator drive motor 310 when closure lid 110 is fully closed. Relay 450 maintains proper polarity within the DC circuit so as to allow closure actuator assembly 300 to be activated in the desired direction and to automatically close closure lid 110 upon a main power failure.

In the preferred embodiment, actuator drive motor 310 is disposed below air passageway housing 100 and interconnected thereto with actuator shaft 320 passing through air passageway housing 100. Alternatively, actuator drive motor 310 may be disposed within air passageway housing 100 and interconnected thereto if desired. Additionally in the preferred embodiment, fan motor limit switch 420, upper closure limit switch 430, and lower closure limit switch 440 are an integral element of, or interconnected to, closure actuator assembly 300.

In an alternative embodiment, the polarity reversal function of relay 450 could be eliminated provided master actuator switch 410 was a three-pole switch wherein the user by operating master actuator switch 410 in one direction would raise closure lid 110 until upper closure limit switch 430 is actuated, and by operating master actuator switch 410 in the other direction would lower closure lid 110 until closure limit switch 440 is actuated. Nevertheless, relay 450, although simpler, would be required to automatically activate closure actuator assembly 300 upon a failure of the main power source.

In another alternative embodiment, switching system 400 electrically controlling the extending and retracting of closure actuator assembly 300 could be replaced with a manually operated system to open and close closure lid 110, thereby sacrificing ease of operation and emergency closing of closure lid 110. The only switch component required would be a master fan control switch, instead of master actuator switch 410, to operate fan assembly 200. Since emergency closing of closure lid 110 is sacrificed, a warning system could be incorporated by typically providing a relay which would activate a warning bell upon a failure of the main power source.

In yet another alternative embodiment, a hydraulic or air cylinder with the appropriate support equipment and a corresponding control switch could replace electrically controlled closure actuator assembly 300 and master actuator switch 410. Also, a rheostat or variable speed control switch may be incorporated within fan assembly 200 to vary the speed of fan motor 210 so as to allow the user of roof vent apparatus 8 the flexibility to control the volume of air discharged through air passageway 102. Furthermore, a humidistat or other moisture sensing device 900 to sense the occurrence of intruding rain or snow, or a heat sensor and/or smoke detector 902 in the event of a fire so as to eliminate the "chimney effect" of open roof vents, may be incorporated within switching system 400 which would signal relay 450 to activate closure actuator assembly 300 and close closure lid 110 in much the same manner as would a main power failure. Also, a solinoid operated latch 330 may be incorporated to positively lock closure lid 110 when closure lid 110 is in the closed position by extending the locking shaft of latch 330 through a shaft receiver 332. Retraction of the locking shaft from receiver 332 would release closure lid 110 so as to allow closure lid 110 to be opened.

In a further alternative embodiment, a plurality of closure actuator assemblies 300 may be used to not only pivot closure lid 110 but also to displace closure lid 110 along the rotational axis of fan motor 210 and fan 220, although the displacement of closure lid 110, without also being pivotally positioned so as to allow a linear air flow through air passageway 102, would frustrate one of the objectives of the invention by being able to provide such a linear air flow so that noise and power usage will be reduced. Also, closure lid 110 may be significantly larger than air passageway housing 100 to provide a sufficient overhang in the raised position such that roof vent apparatus 8 can be used regardless of weather conditions. The use of an overhang on closure lid 110 could also eliminate the need for emergency backup battery 326 since the necessity to lower closure lid 110 due to weather conditions is less crucial.

In operating the apparatus of the invention, master actuator switch 410 when activated (i.e. closed) controls closure actuator assembly 300 which begins opening air passageway housing 100 by lifting closure lid 110. When opening of air passageway housing 100 is first initiated and closure lid 110 is beginning to lift, fan motor limit switch 420 is open and fan assembly 200 does not operate. When closure lid 110 opens to a predetermined point and air passageway 102 is sufficiently clear to permit flow of a sufficient volume of air, fan motor limit switch 420 is closed, activating fan assembly 200 to begin movement of air through air passageway 102 while closure actuator assembly 300 continues operating to fully open air passageway housing 100. When closure lid 110 reaches a fully open position, upper closure limit switch 430 opens to interrupt power to closure actuator assembly 300 and ceases its operation. This control configuration is maintained until master actuator switch 410 is opened.

When master actuator switch 410 is opened, relay 450 is activated to close the circuit supplying the preferred 36 VDC power to closure actuator assembly 300, with reversed polarity as compared to the opening sequence, and closure actuator assembly 300 operates to begin closing closure lid 110. When closure lid 110 closes to a predetermined point, fan motor limit switch 420 controlling activation of fan motor 210 is opened, interrupting power to fan motor 210 and ceasing operation of fan assembly 200. Closure actuator assembly 300 continues to operate until air passageway housing 100 is fully closed and operation is ceased by opening lower closure limit switch 440 to interrupt power to closure actuator assembly 300.

If there is a main power supply failure at any point in the operation of switching system 400, with corresponding loss of high voltage power to fan assembly 200, closure actuator assembly 300 is automatically activated by the preferred 36 VDC backup battery 326 and supplied with the correct polarity by relay 450 to cause closure actuator assembly 300 to operate to close air passageway housing 100. Closure actuator assembly 300 will operate until closure lid 110 is fully closed to seal air passageway 102 and lower closure limit switch 440 is opened to cease operation of closure actuator assembly 300, thus assuring that air passageway housing 100 will close and remain closed until main power is restored and fan assembly 200 will operate.

It should be understood that the electrical requirements for the power actuated roof vent apparatus may be single phase or three phase, high voltage or low voltage, direct current or alternating current, or a combination thereof, provided the electrical components therein are electrically compatible. It should be further understood that such electrical compatibility may be achieved by the addition of electrical conversion components therein which satisfactorily convert the electrical requirements between electrical components.

The foregoing detailed description of the preferred and alternative embodiments of the power actuated roof vent apparatus of the invention are illustrative, and not for purposes of limitation. The power actuated roof vent apparatus of the invention is susceptible to various other modifications and alternative embodiments without departing from the scope and spirit of the invention as claimed.

What is claimed is:

1. A power actuated roof vent apparatus comprising:

an open ended hollow housing having first and second ends, a longitudinal axis, and a continuous side wall;

a closure lid having a continuous edge of the same configuration as the cross-sectional configuration of said housing, with the outside dimensions of said closure lid being slightly larger than the cross-sectional dimensions of said housing, said closure lid being disposed at said first end of said housing so as to close said first end of said housing with said closure lid received against said first end of said housing;

a fan assembly disposed in the interior of said housing and interconnected thereto, said fan assembly including a rotating fan for the purpose of forcing air through the interior of said housing;

fan actuator means for the purpose of inducing rotation of said fan of said fan assembly;

closure actuator means interconnected between said closure lid and said housing for the purpose of separating said closure lid from said housing and opening a passageway through the interior of said housing upon activation of said closure actuator means;

a first power system for providing power to said fan actuator means for the operation thereof;

a second power system for providing power to said closure actuator means for the operation thereof, said second power system being capable of providing power to said closure actuator means independent of said first power means; and control means for activating and controlling said fan actuator means and said closure actuator means such that said fan actuator means is activated only when said closure lid is separated from said housing by operation of said closure actuator means and a passageway through the interior of said housing is open.

2. The power actuated roof vent apparatus of claim 1, wherein said closure lid includes a substantially planar central portion having a continuous edge and a lip interconnected to said edge of said central portion and extending perpendicular to the plane of said central portion, said lip to extend over a portion of said side wall of said housing from said first end thereof with said closure lid received against said first end of said housing in a closed position.

3. The power actuated roof vent apparatus of claim 1, wherein said fan of said fan assembly comprises an impeller type fan having an axis of rotation and rotating about an axle aligned with said axis of rotation, disposed in the interior of said housing with said axis of rotation aligned with the longitudinal axis of said housing, and wherein said fan assembly further includes support means for supporting said fan within the interior of said housing, and wherein said fan actuator means comprises a motor for inducing rotation of said fan.

4. The power actuated roof vent apparatus of claim 3, wherein said motor of said fan actuator means is an electric motor with a rotating output shaft, operatively interconnected to said fan so as to induce rotation of said fan upon activation of said electric motor.

5. The power actuated roof vent apparatus of claim 4, wherein said fan includes a central hub and a plurality of blades symmetrically disposed around and interconnected to said hub, and said axle extends through said hub in fixed relation thereto with a portion of said axle extending on either side of said hub, wherein said support means includes bearing means interconnected to said axle so as to allow rotation of said axle relative to said bearing means, and said support means includes a plurality of struts interconnected between said bearing means and said housing so as to support said bearing means in a fixed position relative to said housing and allow rotation of said fan relative thereto, and wherein said operative interconnection between said fan and said electric motor is such that said fan is induced to rotate at low speed upon activation of said motor.

6. The power actuated roof vent apparatus of claim 1, wherein said closure lid is pivotally interconnected to said housing such that said closure lid is separated from said first end of said housing by inducing rotation of said closure lid about said pivotal interconnection, and wherein said closure actuator means comprises reversible drive means interconnected to said housing and an elongate shaft having first and second ends, interconnected at its first end to said closure lid, extending through the interior of said housing, and operatively interconnected to said drive means such that said elongate shaft is induced to move longitudinally relative to said drive means upon activation of said drive means so as to increase the length of said shaft between said closure lid and said drive means to open said closure lid relative to said housing and to decrease the length of said shaft between said closure lid and said drive means to close said closure lid relative to said housing.

7. The power actuated roof vent apparatus of claim 6, wherein said reversible drive means comprises a reversible electric motor.

8. The power actuated roof vent apparatus of claim 1, wherein said fan actuator means includes an electric motor and said closure actuator means includes a reversible electric motor, and wherein said control means for activating and controlling said fan actuator means and said closure actuator means comprises a master control switch to activate the closure actuator motor so as to induce movement of said closure lid relative to said housing, a fan switch to automatically activate the fan motor when said closure lid is sufficiently open to allow air flow through said air flow passageway, an upper closure limit switch to deactivate the closure actuator motor when said closure lid is in a fully open position, and a lower closure limit switch to deactivate the closure actuator motor when said closure lid is in a fully closed position.

9. The power actuated roof vent apparatus of claim 8, wherein said control means for activating and controlling said fan actuator means and said closure actuator means further comprises a means of reversing the operation of the reversible electric motor of said closure actuator means.

10. The power actuated roof vent apparatus of claim 8, wherein said control means for activating and controlling said fan actuator means and said closure actuator means further comprises a moisture sensing and activating means to monitor for the ingress of rain into the interior of said housing and upon sensing such rain to automatically activate the closure actuator motor so as to initiate closing of said closure lid.

11. The power actuated roof vent apparatus of claim 8, wherein said control means for activating and controlling said fan actuator means and said closure actuator means further comprises a smoke sensing and activating means to monitor for the existence of smoke entering said housing and upon sensing such smoke to automatically activate the closure actuator motor so as to initiate closing of said closure lid.

12. The power actuated roof vent apparatus of claim 8, wherein said control means for activating and controlling said fan actuator means and said closure actuator means further comprises a temperature sensing and activating means to monitor the temperature within said housing and upon sensing a temperature above a predetermined temperature to automatically activate the closure actuator motor so as to initiate closing of said closure lid.

13. The power actuated roof vent apparatus of claim 8, wherein said control means for activating and controlling said fan actuator means and said closure actuator means further comprises a primary power source, a backup power source, and a means of monitoring the primary power source and upon failure of such source to automatically provide backup power and automatically activate the closure actuator motor so as to initiate closing of said closure lid.

14. The power actuated roof vent apparatus of claim 1, further comprising locking means for automatically locking said closure lid in a closed position and for automatically unlocking said closure lid upon activation of said closure actuator means to open said closure lid.

15. The power actuated roof vent apparatus of claim 14, wherein said locking means includes an electrically operated solenoid, with an extendible locking rod, interconnected to said housing near said first end thereof and a locking rod receiver interconnected to said closure lid and disposed so as to receive said locking rod of said solenoid with said closure lid in a closed position.

16. The power actuated roof vent apparatus of claim 1, wherein said closure lid is fully insulated against the transfer of heat therethrough, and wherein said side wall of said housing is fully insulated against the transfer of heat therethrough.

17. A power actuated vent apparatus for exhausting air from the interior of an enclosed structure, comprising:

a hollow open ended housing having a continuous side wall, a longitudinal axis, and first and second ends, forming an air flow passageway for the unrestricted flow of air therethrough;

a closure lid with a continuous edge, slightly larger in external dimension than the cross-sectional dimension of the first end of said housing, with said closure lid disposed over and pivotally interconnected to said first end of said housing such that an air flow passageway substantially free from restriction to the flow of air therethrough is opened through said housing with said closure lid pivoted away from said first end of said housing and said passageway is closed with said closure lid received against said first end of said housing;

a closure lid actuator assembly interconnected between said housing and said closure lid for the purpose of inducing rotation of said closure lid about its pivotal interconnection to said housing so as to open and close said closure lid relative to said housing and respectively open and close said air flow passageway through said housing;

a fan assembly disposed within said housing for the purpose of forcing air from the interior of the enclosed structure through said housing to the exterior of said structure with said closure lid in an open position, said fan assembly including an impeller type fan disposed with the plane of said fan substantially perpendicular to the longitudinal axis of said housing;

a primary power system for providing power to said fan assembly;

a secondary power system, connected to said primary power system, for supplying power to said closure lid actuator assembly; and control means for interactively controlling activation of said closure lid actuating assembly and of said fan assembly such that said closure lid actuator assembly is activated before said fan assembly is activated only when said air flow passageway through said housing is open.

18. The power actuated vent apparatus of claim 17, further comprising sealing means disposed between said first end of said housing and said closure lid for the purpose of creating a substantially air-tight seal between said closure lid and said housing with said closure lid received against said first end of said housing.

19. The power actuated vent apparatus of claim 18, wherein said sealing means comprises a flexible gasket.

20. The power actuated vent apparatus of claim 17, wherein said closure lid actuator assembly comprises a reversible drive motor interconnected to said housing at or near the second end thereof, and an elongate shaft having first and second ends, pivotally interconnected at the first end thereof to said closure lid and operatively interconnected to said drive motor intermediate said first and second ends of said shaft such that the length of the portion of said shaft between said drive motor and said closure lid is selectively lengthened or shortened upon activation of said drive motor to respectively open and close said closure lid.

21. The power actuated vent apparatus of claim 17, wherein said fan assembly further includes a support structure for supporting said fan within said housing and allowing rotational movement of said fan relative to said housing, and a drive motor for inducing rotation of said fan upon activation of said drive motor.

22. The power actuated vent apparatus of claim 17, wherein said closure lid actuator assembly includes an electric motor for inducing rotation of said closure lid about its pivotal interconnection to said housing to open and close said closure lid, wherein said fan assembly includes an electric motor for inducing rotation of said fan relative to said housing to force air through said housing, wherein said primary power system provides electrical power, wherein said secondary power system provides electrical power, wherein said secondary power system includes a backup power source, and wherein said control means comprises a master control switch to activate the closure actuator motor so as to induce movement of said closure lid relative to said housing, a fan switch to automatically activate the fan motor when said closure lid is sufficiently open to allow air flow through said housing, an upper closure limit switch to deactivate the closure actuator motor when said closure lid is in a fully open position, a lower closure limit switch to deactivate the closure actuator motor when said closure lid is in a fully closed position, a polarity reversal relay to reverse the operation of the closure actuator motor so as to allow selection of the direction of movement of said closure lid relative to said housing, and a power source relay to monitor the primary power system and upon loss of power in such system to automatically provide backup power and automatically activate the closure actuator motor so as to initiate closing of said closure lid.

23. The power actuated roof vent apparatus of claim 22, wherein the primary power system provides high voltage alternating current from an external power source, wherein the closure actuator motor is a low voltage direct current motor, wherein the backup power source is a low voltage battery or batteries, and wherein said secondary power system includes a transformer to convert the high voltage alternating current of the primary power system to the low voltage requirements of the closure actuator motor and backup power source.

24. The power actuated roof vent apparatus of claim 17, wherein said control means for controlling said fan actuator means and said closure actuator means further comprises a humidistat to monitor for the ingress of rain into the interior of said housing and upon sensing such rain to automatically activate the closure actuator motor so as to initiate closing of said closure lid.

25. The power actuated roof vent apparatus of claim 17, wherein said control means for controlling said fan actuator means and said closure actuator means further comprises a smoke detector to monitor for the egress of smoke from the interior of said housing and upon sensing such smoke to automatically activate the closure actuator motor so as to initiate closing of said closure lid.

26. The power actuated roof vent apparatus of claim 17, wherein said control means for controlling said fan actuator means and said closure actuator means further comprises a temperature sensor to monitor the temperature within said housing and upon sensing a temperature above a predetermined temperature to automatically activate the closure actuator motor so as to initiate closing of said closure lid.

27. The power actuated roof vent apparatus of claim 17, wherein said control means for controlling said fan actuator means and said closure actuator means further comprises locking means to independently and automatically restrain said closure lid when said closure lid is in its fully closed position.

28. The power actuated vent apparatus of claim 17, wherein the enclosed structure from which air is to be exhausted includes a roof, wherein said housing surrounds an aperture in the roof of the enclosed structure, and wherein said housing is interconnected to such roof in substantially air-tight relation therewith.

29. The power actuated vent apparatus of claim 17, wherein said closure lid is insulated against the transfer of heat therethrough between the interior of the enclosed structure and the exterior thereof, and said housing is insulated against the transfer of heat therethrough between the interior of the enclosed structure and the exterior thereof.

30. A method of operating and controlling a power actuated vent apparatus for the purpose of selectively exhausting air from the interior of an enclosed structure having side walls and a roof, such power actuated vent apparatus having a hollow open ended housing with first and second ends, disposed around in aperture in a side wall or roof of such structure and interconnected thereto, having a closure lid at the first end of the housing to open an air flow passageway through the housing with the closure lid in an open position and close the air flow passageway with the closure lid in a closed position, having a motor driven closure actuator to open and close the closure lid, having a motor driven fan disposed in the interior of the housing to force air therethrough, and having a control system, comprising the steps of:

with the closure actuator motor and the fan motor inactive, activating the closure actuator motor to initiate opening of the closure lid from the housing;

when the closure lid has opened sufficiently to open an air flow passageway through the housing, automatically activating the fan motor to initiate operation of the fan to exhaust air from the interior of the structure;

when the closure lid has reached a fully open position, automatically deactivating the closure actuator motor to maintain the closure lid in a fully open position;

continuing operation of the fan motor to exhaust air from the interior of the enclosed structure for so long as may be desired;

then activating the closure actuator motor to initiate closing of the closure lid while continuing operation of the fan motor;

when the closure lid has closed to a predetermined point so as to restrict flow of air through the air flow passageway, automatically deactivating the fan motor so as to cease operation of the fan;

when the closure lid has reached a fully closed position, automatically deactivating the closure actuator motor to maintain the closure lid in a fully closed position, completing the cycle of operation.

31. The method of claim 30, wherein the closure actuator motor of the power actuated vent apparatus is a reversible motor and the apparatus further includes means for reversing the operation of the closure actuator motor, and comprising the additional steps of after the closure lid has reached a fully open position, activating the means of reversing the operation of the closure actuator motor, so as to induce closing of the closure lid upon subsequent activation of the closure actuator motor; and after the closure lid has reached a fully closed position, activating the means of reversing the operation of the closure actuator motor, so as to induce opening of the closure lid upon subsequent activation of the closure actuator motor.

32. The method of claim 30, wherein the power actuated vent apparatus further includes a moisture sensor and switch assembly to monitor for and activate upon sensing the ingress of rain to the interior of the enclosed structure through the housing of the power actuated vent apparatus, and the method comprises the additional steps of monitoring for the ingress of rain to the interior of the enclosed structure after activation of the fan motor;

upon sensing ingress of rain to the interior of the enclosed structure with the closure lid in an open position, automatically activating the switch of the moisture sensor and switch assembly to activate the closure actuator motor and initiate closing of the closure lid.

33. The method of claim 30, wherein the power actuated vent apparatus further includes a smoke sensor and switch assembly to monitor for and activate upon sensing the egress of smoke from the interior of the enclosed structure through the housing of the power actuated vent apparatus, and the method comprises the additional steps of monitoring for the egress of smoke from the interior of the enclosed structure after activation of the fan motor;

upon sensing egress of smoke from the interior of the enclosed structure with the closure lid in an open position, automatically activating the switch of the smoke sensor and switch assembly to activate the closure actuator motor an initiate closing of the closure lid.

34. The method of claim 30, wherein the power actuated vent apparatus further includes a temperature sensor and switch assembly to monitor for and activate upon sensing a predetermined temperature indicating the existence of a fire in the interior of the enclosed structure, and the method comprises the additional steps of monitoring the temperature of air exhausted from the interior of the enclosed structure after activation of the fan motor;

upon sensing a predetermined temperature indicating the presence of a fire in the interior of the enclosed structure with the closure lid in an open position, automatically activating the switch of the temperature sensor and switch assembly to activate the closure actuator motor and initiate closing of the closure lid.

35. The method of claim 30, wherein the power actuated vent apparatus is provided with a primary source of electrical power, the closure actuator motor and the fan motor of the power actuated vent apparatus are electric motors, the power actuated vent apparatus includes a backup source of electrical power, the power actuated vent apparatus further includes a sensing and switching means to monitor for and activate upon sensing a failure of the primary source of electrical power, and the method of the invention comprises the additional steps of monitoring for failure of the primary source of electrical power to the power actuated vent apparatus with the closure lid in a open position;

upon failure of the primary source of electrical power to the power actuated vent apparatus with the closure lid in an open position, automatically activating the switch of the sensing and switching means to supply backup power to and activate the closure actuator motor to initiate closing of the closure lid.

* * * * *